US008746819B2

(12) United States Patent
Donmez et al.

(10) Patent No.: US 8,746,819 B2
(45) Date of Patent: Jun. 10, 2014

(54) COOLING DEVICE

(76) Inventors: Ersin Donmez, Istanbul (TR); Osman Cengiz, Istanbul (TR); Levent Hasanreisoglu, Istanbul (TR)

( * ) Notice: Subject to any disclaimer, the term of this patent is extended or adjusted under 35 U.S.C. 154(b) by 0 days.

(21) Appl. No.: 13/520,164

(22) PCT Filed: Dec. 22, 2010

(86) PCT No.: PCT/EP2010/070515

§ 371 (c)(1),
(2), (4) Date: Jun. 29, 2012

(87) PCT Pub. No.: WO2011/080179

PCT Pub. Date: Jul. 7, 2011

(65) Prior Publication Data

US 2012/0319552 A1 Dec. 20, 2012

(30) Foreign Application Priority Data

Dec. 30, 2009 (TR) ..... a 2009 09990

(51) Int. Cl.
*A47B 96/04* (2006.01)

(52) U.S. Cl.
USPC ..... 312/408

(58) Field of Classification Search
USPC ..... 312/319.5, 319.7, 317.8, 408; 108/147, 108/147.19
See application file for complete search history.

(56) References Cited

U.S. PATENT DOCUMENTS

| | | | | | |
|---|---|---|---|---|---|
| 4,065,194 | A | * | 12/1977 | Mattia | 312/247 |
| 5,199,778 | A | * | 4/1993 | Aoki et al. | 312/408 |
| 2009/0127993 | A1 | * | 5/2009 | Hrubesch | 312/408 |
| 2009/0261704 | A1 | * | 10/2009 | Benz et al. | 312/408 |

FOREIGN PATENT DOCUMENTS

WO WO2007062913 * 6/2007

* cited by examiner

*Primary Examiner* — Matthew Ing
(74) *Attorney, Agent, or Firm* — Venable, Campillo, Logan & Meaney, PC.

(57) ABSTRACT

The present cooling device (1) comprises a shelf (3) the height of which can be adjusted. The cooling device (1) further comprises a body (2), at least one shelf (3) disposed inside the body (2) whereon the foodstuffs are placed and which can be raised or lowered.

14 Claims, 4 Drawing Sheets

COOLING DEVICE

Figure 1:
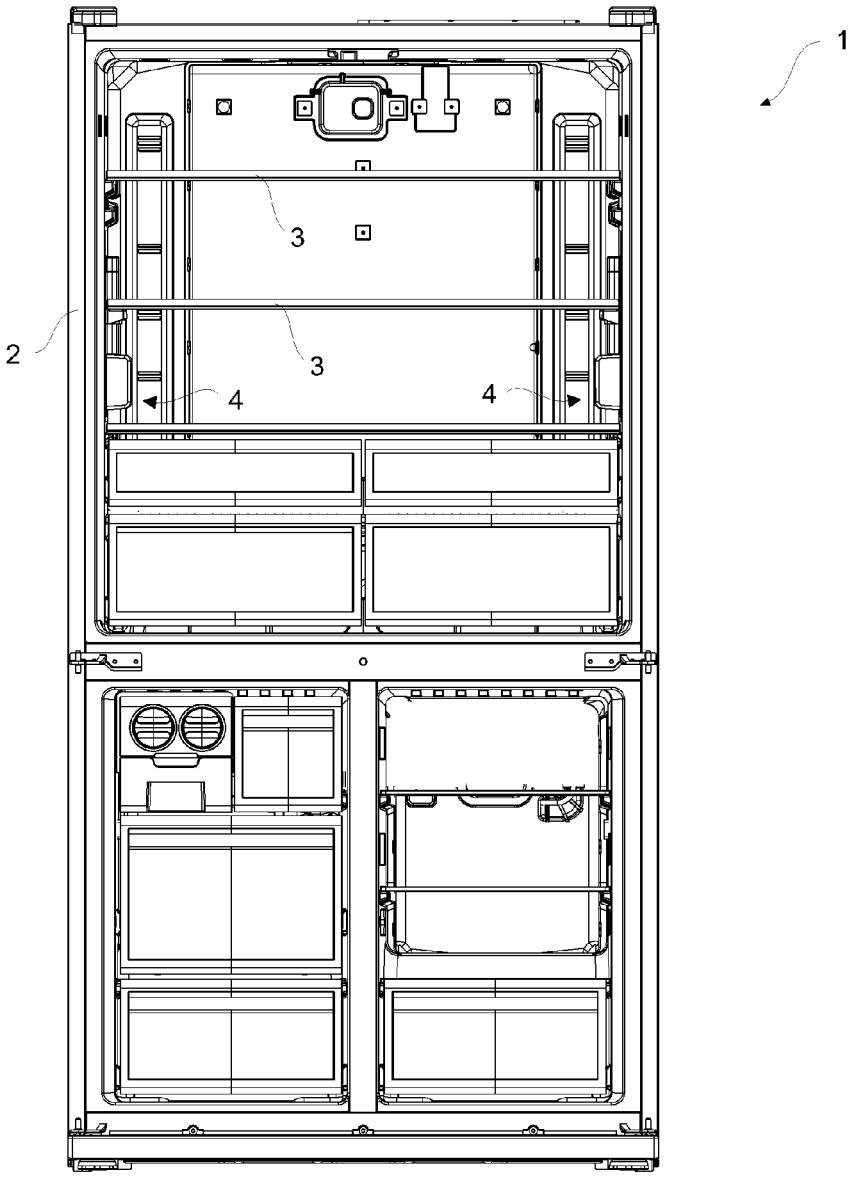

The present invention relates to a cooling device comprising a shelf the height of which can be adjusted.

In cooling devices such as refrigerators and deep freezers the foodstuffs and various containers are placed on the shelves. Depending on the needs of the user, the distance between the two shelves can be required to be changed, in other words the height of the shelf in the body can be required to be adjusted.

In the state of the art, various embodiments are known wherein the height of the shelf is changed as a result of the user turning an arm or pressing a button by means of a movement transmission means.

Such an embodiment is explained in the state of the art Japanese Patent Application No. JP2004173959. In this embodiment, a rack gear is provided on both sides of the refrigerator body extending from the top to bottom along the line the shelf is moved and a pinion gear is provided at each side of the shelf that provides movement on this rack gear. Furthermore, a worm gear each is disposed under both of the pinion gears that transmit movement to the pinion gears. The worm gears are connected to each other by means of a rod and can be controlled by the user by means of a control arm disposed at the center of the rod. The worm gear, the rod and the control arm are disposed at the bottom center of the shelf.

In the state of the art European Patent Application No. EP1957919, an embodiment is explained wherein a similar mechanism is driven by means of a motor mounted to one end of the rod that transmits the movement.

However, in these state of the art embodiments, the transmission setups used for transmitting motion to the movement mechanisms disposed on both sides of the shelf occupy space inside the cooling device and create customer dissatisfaction in terms of both visual and hygienic aspects.

The aim of the present invention is the realization of a cooling device comprising a shelf the height of which is easily adjustable.

The cooling device realized in order to attain the aim of the present invention is explicated in the attached claims. The cooling device of the present invention comprises two holders mounted oppositely on the side walls of the body, supporting and carrying the shelf whereon foodstuffs are placed from the sides facing the side wall and at least one movement mechanism belonging to each holder, providing the upwards downwards movement of the holder connected thereto and having a motor that provides the required drive for its movement.

In the said cooling device at least one of the shelves is supported to be movable upwards and downwards by means of two movement mechanisms mounted oppositely on the side walls of the body. Both of the movement mechanisms are connected to a motor each that provides the required drive for moving the shelf upwards and downwards. In other words, the upward and downward movement of the right and left sides of the shelf is realized with the drive provided by separate motors. Consequently, the need for disposing complex drive transmission setups between the two movement mechanisms is eliminated. The movement mechanisms operate independently from each other but are controlled together electrically.

Switches are used for stopping the shelf at the last top and bottom points whereto it is intended to proceed. The switches that the shelf contacts upon reaching the uppermost and lowermost positions, causes the motor to stop by cutting off the electricity supplied to the motor that provides the drive for the respective movement mechanism. Thus, the movement of the shelf beyond the desired uppermost and lowermost points is prevented. Furthermore, since both of the movement mechanisms are stopped by separate switches, the possibility of the shelf standing inclined due to probable synchronization problems between the motors is eliminated.

In the preferred embodiment of the present invention, the movement mechanism comprises a transmission shaft the outer surface of which is in threaded form that is rotated by the motor. A holder having a housing with grooved inner surface is mounted onto the transmission shaft. The holder is prevented from rotating around the transmission shaft and thus the holder is provided to move upwards or downwards when the transmission shaft rotates. The shelf is placed on the holders positioned oppositely on both of the side walls and is supported by the holders.

In an embodiment of the present invention, the movement mechanism furthermore comprises a support means disposed between the body side wall and the holder. A hole is arranged on the side of the holder facing the support means. A preferably metal rod is placed into the hole and secured to the support means from both ends. By means of the rod, the holder is prevented from rotating around the transmission shaft.

In the preferred embodiment of the present invention, the holder arm, being the portion of the holder supporting the shelf, extends along the body side wall. Thus, the shelf is carried safely by being supported along the width thereof.

In an embodiment of the present invention, an opening is provided on the holder, disposed between the housing and the holder arm, spaced apart from the transmission shaft, formed so as to partially surround the transmission shaft. A lid is disposed inside the opening that prevents the transmission shaft from being seen from inside the cooling device by closing the front thereof. The lid prevents both the components of the movement mechanism from getting dirty and also avoids the view of a complex movement mechanism inside the cooling device thereby enabling a plain appearance. The lid does not move together with the transmission shaft. In an embodiment of the present invention, the lid is configured with the size and dimension to also cover the motor.

In the preferred embodiment of the present invention, the opening and hence the lid are convex so as to project to the straight line of the holder arm whereon the shelf is disposed. In other words, the lid placed into the opening projects towards over the holder arm. In this embodiment, the shelf comprises a recess matching the portion of the lid projecting over the holder arm. When the shelf is placed on the holder arm, the recess clasps the portion of the lid projecting over the holder arm and thus the upwards, downwards movement of the shelf becomes more balanced.

In an embodiment of the present invention, the movement mechanism and the motor are secured on a receptacle and can be mounted all together at once on the body side wall by means of the receptacle. A socket is provided on the body side walls wherein the receptacle is placed. The receptacle is preferably snap fittingly seated into the socket. A skirt is provided all around on the sides of the receptacle that is seated on the body side wall when fitted into the socket.

In the preferred embodiment of the present invention, the receptacle comprises more than one passage for passing the cables that provide supply of electricity to the motor and the switches.

The model embodiments that relate to the cooling device realized in order to attain the aim of the present invention are illustrated in the attached figures, where:

FIG. 1—is the front view of a cooling device.

Figure 2:
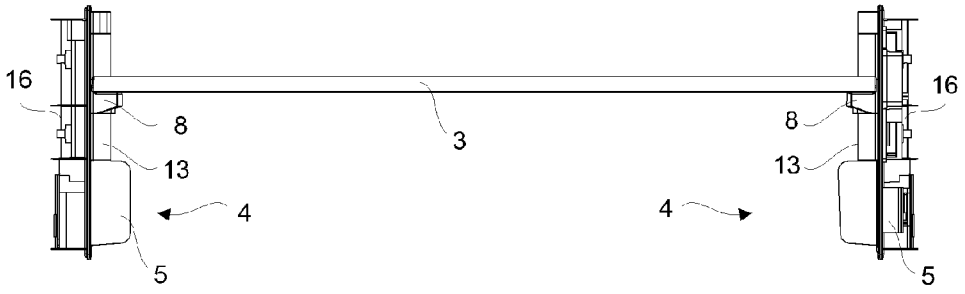

FIG. 2—is the front view of the shelf and the movement mechanisms in an embodiment of the present invention.

Figure 3:
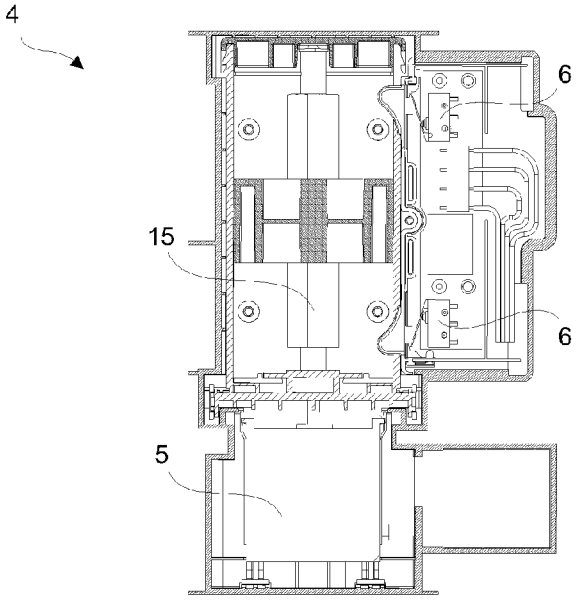

FIG. 3—is the cross sectional view of the movement mechanism in an embodiment of the present invention.

Figure 4:
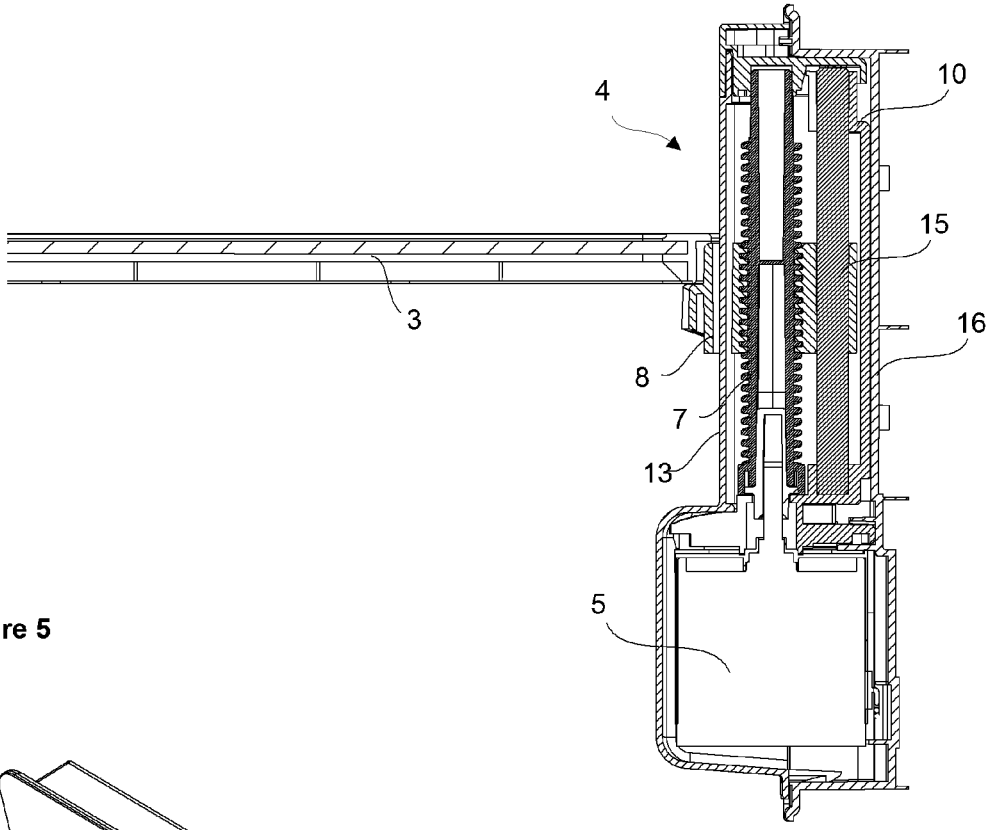

FIG. 4—is the cross sectional view of the shelf and the movement mechanism in an embodiment of the present invention.

Figure 5:
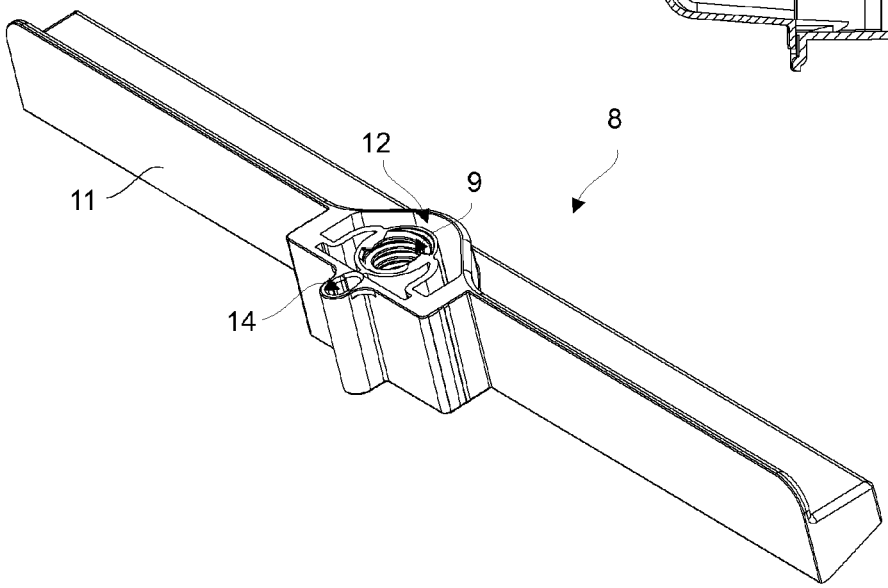

FIG. 5—is the perspective view of the holder in an embodiment of the present invention.

Figure 6:
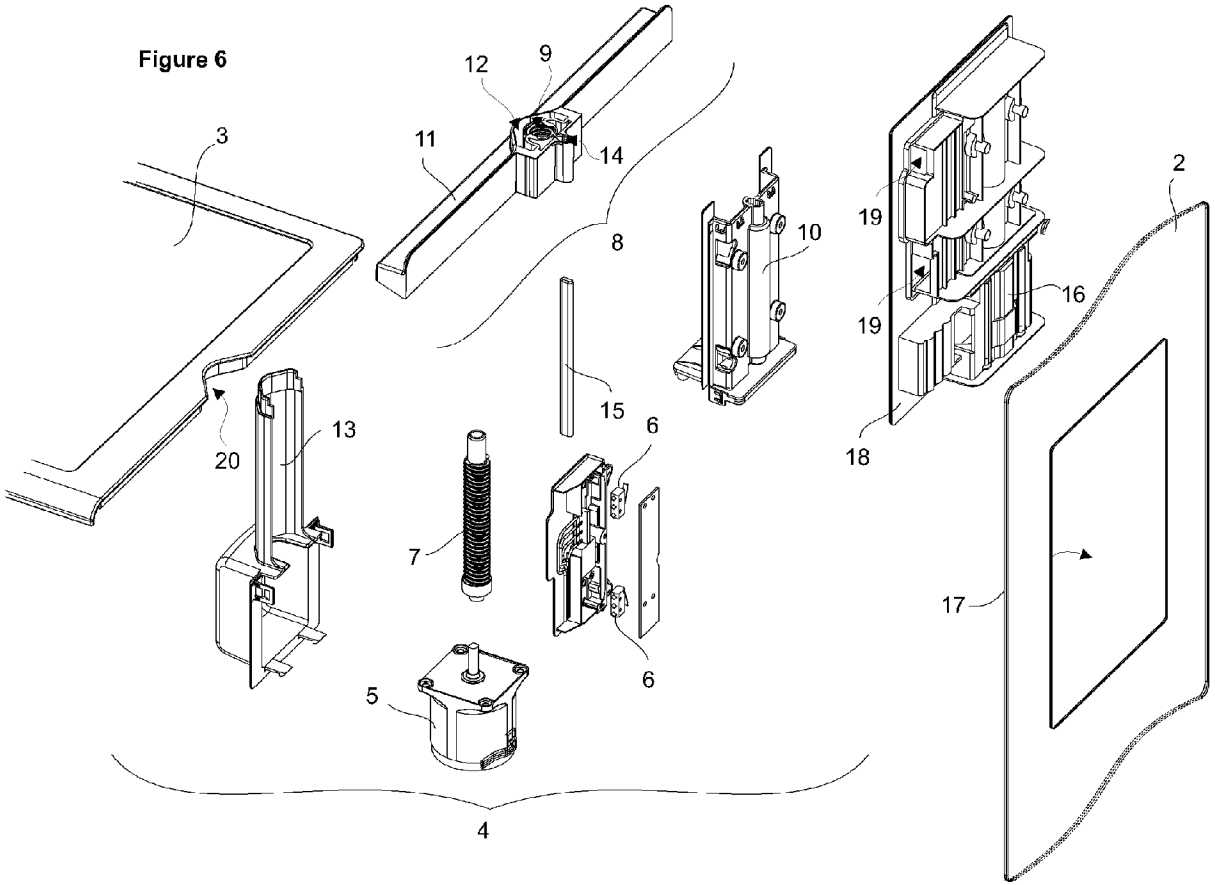

FIG. 6—is the exploded view of the movement mechanism in an embodiment of the present invention.

The elements illustrated in the figures are numbered as follows:

1. Cooling device
2. Body
3. Shelf
4. Movement mechanism
5. Motor
6. Switch
7. Transmission shaft
8. Holder
9. Housing
10. Support means
11. Holder arm
12. Opening
13. Lid
14. Hole
15. Rod
16. Receptacle
17. Socket
18. Skirt
19. Passage
20. Recess The cooling device (1) of the present invention comprises:

a body (2), at least one shelf (3) disposed inside the body (2) whereon the foodstuffs are placed and which can be raised or lowered, two holders (8) mounted on the side walls of the body (2) oppositely, supporting and carrying the shelf (3) from the sides thereof facing the side wall and at least one movement mechanism (4) for each holder (8), having a motor (5) providing the upwards downwards movement of the holder (8) to which the motor (5) is connected, providing the required drive for the movement thereof (FIG. 1).

The loss of volume under the shelf (3) or on the rear wall of the body (2) is prevented, since the need for transmitting the drive is not required by means of a movement mechanism (4) assigned for each holder (8) and the separate motors (5) that provide the required drive for each movement mechanism (4).

The movement mechanism (4) furthermore comprises two switches (6) disposed at the lowermost and uppermost points whereto the shelf (3) can be lowered and raised during its upwards, downwards movement, which provides the energy supplied to the motor (5) to be cut off as a result of the shelf (3) reaching the height the switches (6) are disposed on and triggering them, and provides the movement mechanism (4) to stop. Consequently, the movement mechanisms (4) at both sides of the shelf (3) are enabled to stop the shelf (3) at equal heights.

In the preferred embodiment of the present invention, the movement mechanism (4) comprises a transmission shaft (7), the outer surface of which is in threaded form and that rotates with the drive provided by the motor (5) whereto the movement mechanism (4) is connected.

The holder (8) comprises a housing (9) with the inner surface being grooved and wherein the transmission shaft (7) is placed. The connection between the holder (8) and the movement mechanism (4) and hence the motor (5) is provided by the transmission shaft (7) being placed into the housing (9).

In an embodiment of the present invention, the movement mechanism (4) furthermore comprises a support means (10) disposed between the body (2) side wall and the holder (8).

In an embodiment of the present invention, the holder (8) comprises a hole (14) on the side thereof facing the support means (10). In this embodiment, the movement mechanism (4) comprises a rod (15) placed into the hole (14), secured to the support means (10) from both ends and preventing the holder (8) from rotating around the transmission shaft (7). The rod (15) provides the holder (8) to move upwards and downwards as the transmission shaft (7) rotates by preventing the holder (8) from rotating around the transmission shaft (7). Furthermore the rod (15) carries some portion of the moment affecting on the transmission shaft (7) and the holder (8) while the shelf (3) is loaded and decreases the moment acting thereon. The rod (15) is preferably produced from metal material.

In an embodiment of the present invention, the holder (8) comprises a holder arm (11) that extends along the body (2) side wall whereon the shelf (3) is placed. Thus, the shelf (3) is provided to be carried in a balanced manner.

In an embodiment of the present invention, the holder (8) comprises a C shaped opening (12) situated between the housing (9) and the holder arm (11). In this embodiment the movement mechanism (4) comprises a lid (13) disposed in the opening (12), preventing the transmission shaft (7) from being seen from inside the cooling device (1) by closing the front thereof. Thus, the movement mechanism (4) is provided to be kept clean and not to annoy the user visually.

The lid (13) is immovable and the holder (8) slides over the lid (13) during the upwards, downwards movement thereof. In other words, the lid (13) also guides the movement of the holder (8) together with the rod (15). Consequently, the upwards and downwards movement of the holder (8) and hence the shelf (3) is guided by the lid (13) on one side and by the rod (15) on the other side.

In an embodiment of the present invention, the lid (13) is configured with the size and dimension to also cover the motor (5). Thus, both the transmission shaft (7) and the motor (5) are provided to be covered by the lid (13).

In the preferred embodiment of the present invention, the lid (13) forms a protrusion towards over the holder arm (11). In this embodiment, the shelf (3) comprises a recess (20) at the portion thereof aligned with the lid (13) when placed on the holder arm (11), matching the protrusion formed by the lid (13) on the holder arm (11). Thus, the upward, downward movement of the shelf (3) becomes more balanced.

In an embodiment of the present invention, the cooling device (1) comprises a receptacle (16) whereon the support means (10), the motor (5), the lid (13), the switch (6), the transmission shaft (7) and the rod (15) are secured, providing them to be mounted on the body (2) side wall all together. Consequently, the movement mechanism (4) and the motor (5) can be assembled in the cooling device (1) easily and in one action.

In this embodiment, the body (2) furthermore comprises a socket (17) disposed on the side walls thereof wherein the receptacle (16) is placed. The receptacle (16) is preferably snap fittingly seated into the socket (17). The receptacle (16) comprises a skirt (18) all around on the sides thereof, that is seated on the body (2) side wall by remaining outside when fitted into the socket (17). Consequently, the receptacle (16) is easily mounted onto the body (2) side wall.

In this embodiment of the present invention, the receptacle (16) comprises more than one passage (19) for passing the cables that provide electricity to be supplied to the motor (5) and the switches (6).

It is to be understood that the present invention is not limited by the embodiments disclosed above and a person skilled in the art can easily introduce different embodiments. These should be considered within the scope of the protection postulated by the claims of the present invention.

The invention claimed is:

1. A cooling device (1) comprising a body (2), at least one shelf (3) disposed inside the body (2) and which can be raised or lowered, and two holders (8) mounted oppositely on the side walls of the body (2), supporting and carrying the shelf (3) from the sides thereof facing the side wall and wherein each holder (8) separately has at least one movement mechanism (4) and each at least one movement mechanism (4) separately includes a motor (5) for providing upwards and downwards movement of the holder (8).

2. The cooling device (1) as in claim 1, wherein the movement mechanism (4) further comprises two switches (6) disposed at lowermost and uppermost points whereto the shelf (3) can be lowered and raised during upwards and downwards movement, and which cut off the energy supplied to each separate motor (5), respectively, as a result of the shelf (3) triggering by reaching the height where it is disposed and thereby providing the movement mechanism (4) to stop.

3. The cooling device (1) as in claim 1, wherein each at least one movement mechanism (4) further comprises a transmission shaft (7) having an surface of which is in threaded form, rotating with the drive provided by each motor (5) whereto the each at least one movement mechanism (4) is connected and wherein each holder (8) includes a housing (9) with an inner surface being grooved and wherein the transmission shaft (7) is placed.

4. The cooling device (1) as in claim 3, wherein each at least one movement mechanism (4) further comprises a support means (10) disposed between the body (2) side wall and each holder (8), wherein the holder (8) further comprises a hole (14) disposed on the side thereof facing the support means (10) and each at least one movement mechanism (4) further comprises a rod (15) placed into the hole (14), secured to the support means (10) from both ends, preventing each holder (8) from rotating around the transmission shaft (7).

5. The cooling device (1) as in claim 4, wherein each holder (8) further comprises a holder arm (11) that extends along the body (2) side wall and whereon the shelf (3) is placed.

6. The cooling device (1) as in claims 5, wherein each holder (8) further comprises a C shaped opening (12) situated between the housing (9) and situated on each holder (8), the holder arm (11) and each at least one movement mechanism (4) comprising a lid (13) preventing the transmission shaft (7) which is disposed in the opening (12), from being seen from inside the cooling device (1) by closing a front of the cooling device (1).

7. The cooling device (1) as in claim 6, wherein the lid (13) forms a protrusion towards over the holder arm (11) and the shelf (3) further comprises a recess (20) at the portion thereof aligned with the lid (13) when placed on the holder arm (11), matching the protrusion formed by the lid (13) on the holder arm (11).

8. The cooling device (1) as in claim 6, wherein the lid (13) configured with a size and dimension to also cover the motor (5).

9. The cooling device (1) as in claim 6, further comprising a receptacle (16) whereon the support means (10), the motor (5), the lid (13), the switch (6), the transmission shaft (7) and the rod (15) are secured, providing them to be mounted on the body (2) side wall all together.

10. The cooling device (1) as in claim 9, wherein the body (2) further comprises a socket (17) disposed on the side walls thereof wherein the receptacle (16) is placed.

11. The cooling device (1) as in claim 10, wherein the receptacle (16) is snap-fittingly seated into the socket (17).

12. The cooling device (1) as in claim 10, wherein the receptacle (16) further comprises a skirt (18) situated all around on the sides of the socket (17), that is seated on the body (2) side wall by remaining outside when the receptacle (16) is placed into the socket (17).

13. The cooling device (1) as in claim 10, wherein the receptacle (16) comprising more than one passage (19) for passing the cables providing electricity to be supplied to the motor (5) and the switches (6).

14. The cooling device (1) as in claim 9, wherein the receptacle (16) comprising more than one passage (19) for passing the cables providing electricity to be supplied to the motor (5) and the switches (6).

* * * * *